United States Patent [19]

Reed

[11] Patent Number: 4,744,710

[45] Date of Patent: May 17, 1988

[54] DRILLING DERRICK WITH EXTERNAL PIPE STORAGE

[75] Inventor: Lowell M. Reed, Moore, Okla.

[73] Assignee: Parco Mast and Substructures, Del City, Okla.

[21] Appl. No.: 934,419

[22] Filed: Nov. 24, 1986

[51] Int. Cl.[4] ..... E21B 19/14

[52] U.S. Cl. ..... 414/22; 175/52; 211/70.4

[58] Field of Search ..... 414/22, 745; 175/52, 175/85; 211/70.4

[56] References Cited

U.S. PATENT DOCUMENTS

| | | | |
|---|---|---|---|
| Re. 29,541 | 2/1978 | Russell | 414/22 X |
| 3,365,008 | 1/1968 | Zimmerman et al. | 175/85 |
| 3,513,996 | 5/1970 | Woolslayer et al. | 414/22 |
| 3,716,149 | 2/1973 | Scaggs | 414/22 |
| 3,840,128 | 10/1974 | Swoboda et al. | 414/22 X |
| 4,208,158 | 6/1980 | Davies et al. | 414/22 |
| 4,417,846 | 11/1983 | Elliston | 414/22 X |
| 4,610,315 | 9/1986 | Koga et al. | 414/22 X |

FOREIGN PATENT DOCUMENTS

| | | | |
|---|---|---|---|
| 2155520 | 9/1985 | United Kingdom | 175/85 |

*Primary Examiner*—Leslie J. Paperner
*Attorney, Agent, or Firm*—Head & Johnson

[57] ABSTRACT

A drilling rig which may have a beta mast is used for drilling holes in the earth. The mast has four quadrants. On one side there is located the drawworks. On a side 90° therefrom is the side having the V door through which drilling pipe can be raised and lowered by the traveling block. In the quadrant 180° from the V-door is a pipe racking board. The racking board is outside the normal work area within the derrick. Thus, one can obtain entry of the drill pipe through the V door without the pipe stored in the racking board interferring therewith. With this design there is no limitation to the amount of pipe that can be stored.

5 Claims, 3 Drawing Sheets

DRILLING DERRICK WITH EXTERNAL PIPE STORAGE

BACKGROUND OF THE INVENTION

1. Field of the Invention:

This invention pertains to drilling rigs for use in drilling boreholes in the earth such as those drilled in the search for oil and gas.

2. Description of the Prior Art:

As is well known drilling derricks or rigs are used to drill holes in the earth in a search for oil and gas. The most common method is the rotary drilling method in which a bit is suspended at the lower end of a string of drill pipe and the drill pipe is rotated by a rotary table placed at the bottom of the derrick. Drilling fluid is circulated down through the drill pipe and up through the annulus between the drill pipe and the wall of the borehole to remove cuttings from the bottom of the hole as they are formed by the rotation of the bit. As the hole gets deeper, additional joints or sections of drill pipe has to be added. When additional joints are needed the joint is connected to the traveling block which is suspended inside the derrick. After entering through what is known as a V-door which is an opening in the side of the derrick, the joint of drill pipe is raised to a vertical position where it is connected to the drill pipe already in the well bore. This, of course, is repeated until the well is drilled to its required depth. Another type pipe is used to line the well bore and is commonly called casing. This casing likewise is added joint by joint and lowered into the well bore. The additional joints of drill pipe is commonly brought in through the same V-door as the drill pipe and is connected to the previous strings of casing and lowered in the same manner as discussed for the drill pipe. Many patents have issued on the drilling derrick and related equipment. One such patent is U.S. Pat. No. Re 29,541 which shows the pipe P mounted in a pipe storing rack 35 on the same side of the drilling derrick as is open forward access 33 which is provided for removing and placing drill pipe relative to the power swivel. Other patents which relate to the handling or racking of pipes and derricks includes U.S. Pat. No. 2,628,725; 4,274,778; 4,208,158; 4,117,941; 2,412,020; and 4,044,895. To the best of my knowledge in all of the prior derricks, none of the pipe racking means are located on 180° from the V-door or the opening to which the drill pipe is to enter the derrick. The stored pipe is within the derrick such as shown in U.S. Pat. No. 2,412,020 where the stored pipe is within the frame of the derrick itself. This prior storage arrangement restricts the amount of drill pipe that can be racked. Also, when there is restriction in a working area such as when the pipe is stored at the same area as the V-door, then there is considerable restriction so that if one has a casing stored and is trying to enter drill pipe into the derrick there is considerable obstruction as one gets in the way of the other. This is certainly an awkward arrangement and is an operation which needs to be improved.

SUMMARY OF THE INVENTION

My invention relates to a novel modification of drilling rigs and derricks used for drilling oil and gas wells in the earth. It includes a mast which is preferably of the type that has two essentially parallel legs which are held in spaced apart position by bracing. The space between the legs may be called the work area. A crown block is positioned at the top of the derrick and a traveling block is suspended therefrom. The derrick has a V-door opening which is arranged 90° from the drawworks. Located 180° from the V-door or on the opposite side or quadrant of the derrick from the V-door there is a racking means which is entirely exterior of the two legs of the derrick. This includes a racking board normally about half way up the derrick and a pipe rack setback near the lower end of the derrick. This racking board is accessible from the exterior of the derrick or from the interior work area of the derrick. A crane is mounted at the top of the derrick and can be used for raising and lowering pipe outside the derrick into the racking board. This stored pipe is completely out of the way and does not interfere with the work area or the entry of drill or other pipe through the V-door. In as much as I store my stored pipe 180° or on the opposite side of the derrick from the V-door and also outside the derrick frame or legs itself, there is really no limitation on the amount of stored pipe that can be racked. Also, because I have my stored pipe outside the derrick there is no restriction to the working area and also no restriction on incoming and outgoing pipe through the V-door.

DETAILED DESCRIPTION OF THE PREFERRED EMBODIMENT

Figure 1:
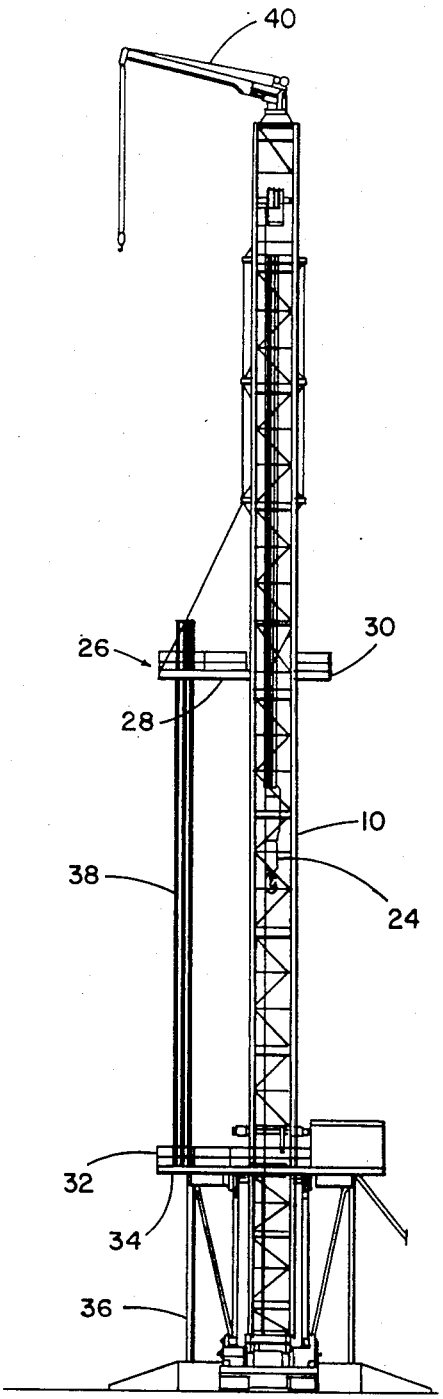
FIG. 1 is a side view of a derrick utilizing my invention with the pipe rack exterior of the derrick and opposite or 180° from the V-door opening.
Figure 2:
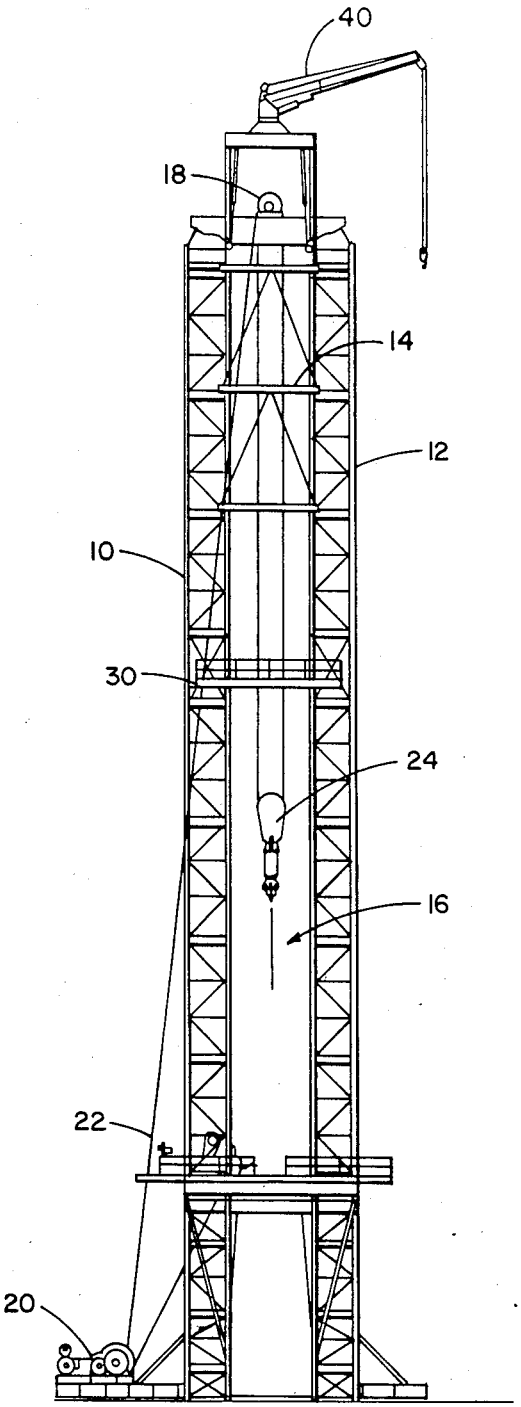
FIG. 2 is a view showing the derrick of FIG. 1 rotated 90°.

Attention is first directed to FIGS. 1 and 2 which show the derrick having a first leg 10 and a second leg 12. These legs are essentially parallel and preferably are of the same size in cross section from the bottom to the top. They are held together by various braces 14. A work space 16 is provided between the legs 10 and 12 and extends essentially from the top to bottom of the derrick. At the top of the derrick there is a crown block 18. The drawworks 20 is mounted on the ground at the base of the derrick and is provided with a power cable 22 which extends up over crown block 18 and down to traveling block 24. By taking up or letting out on line 22 the traveling block will either be lowered or raised within the work space 16.

Attention is next directed specifically to FIG. 1 which shows a racking board 26 which is supported from legs 10 and 12 such as by cantilever 28 which is the same height as working platform 30. This racking board 26 is shown as being about halfway up the derrick. However, it could be at various desired positions. A pipe rack setback 32 is supported outside the derrick near the lower end thereof. The pipe rack setback is suppoted from a base 34 which has vertical supports 36. Pipe 38 is shown stored in racking board 26 and pipe rack setback 32. A crane 40 is provided at the top of the derrick and may be used for lifting pipe 38 into or out of the stored position in racking board 26.

Figure 3:
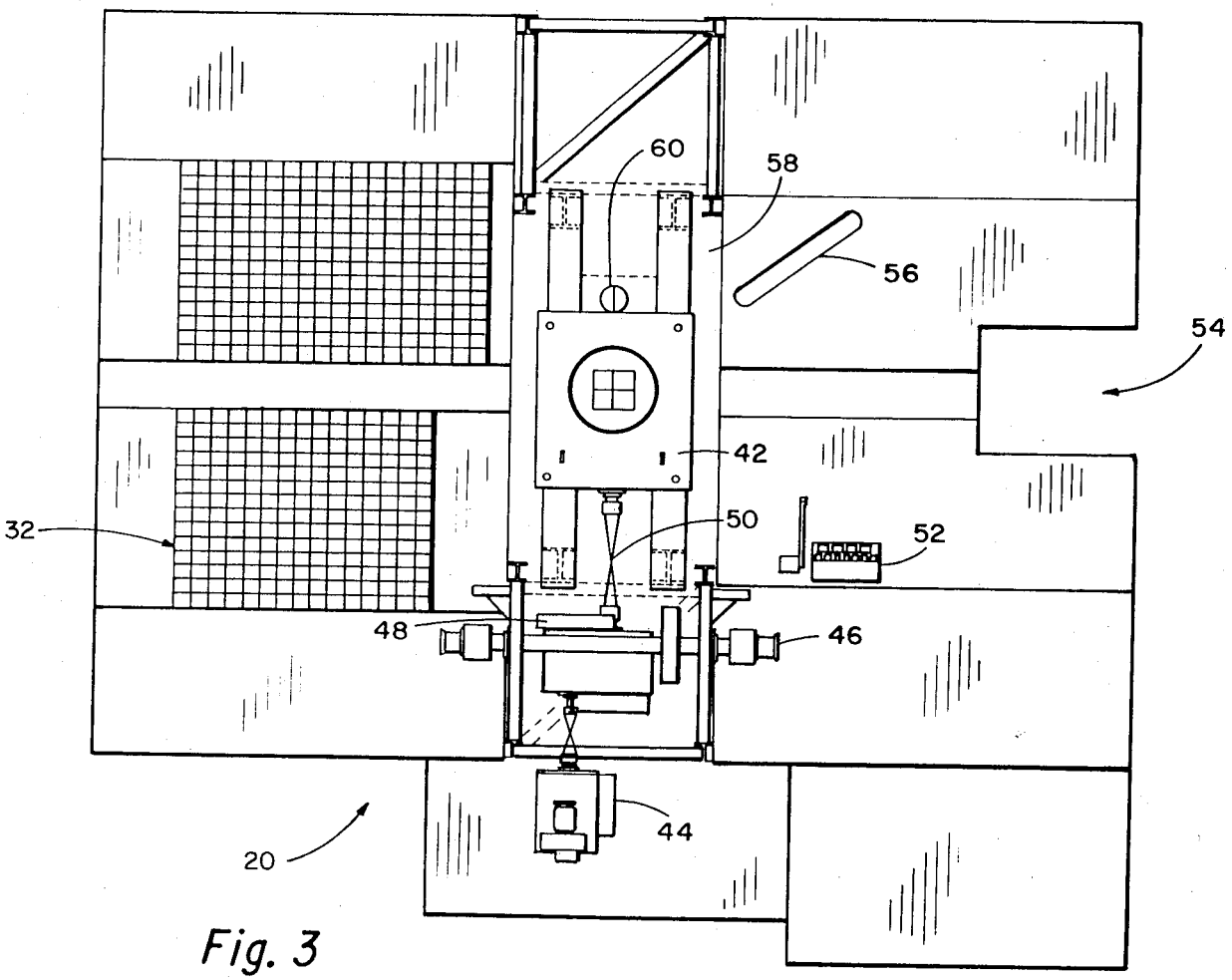
FIG. 3 is a schematic view showing the V-door, the drawworks, the rotary table and the set backs for the stored pipe.

Attention is next directed to FIG. 3 which shows a view showing the arrangement of the various components at the vicinity of the pipe rack setback 32. Shown in FIG. 3 is a drawworks 20 set at a first position with respect to the rotary table 42. As is well known rotary table 42 is used to turn the drill pipe which goes down through the center thereof. The hole in the rotary table where the drill pipe goes through is considered the center of the derrick. As shown in FIG. 3 the racking board is 180° from V-door 54. By considering the well or center of rotary table 42 as a center of four quadrants, one can consider the drawbacks is in the first quadrant, the V-door in the second and the pipe rack board 26 and pipe rack set back 32 in the fourth quadrant. The drawworks 20 is in one position with respect to the rotary table or center line. This drawworks includes a motor 44, cathead 46 and rotary clutch 48 which are all well known and no further description needs to be made thereon. Also provided is drilling console 52. Ninety degrees from the drawworks 20 with respect to the center is a V-door 54. When drill pipe is to be added to the drill string already in the hole being drilled the traveling block 24 is lowered downwardly and is attached to one end of the drill pipe. The V-door 54 facilitates the entry of the joint of drill pipe being raised into the work space 16. A rat hole 56, a rotary beam 58 and a mouse hole 60 are also shown and are also all well known.

Figure 4:
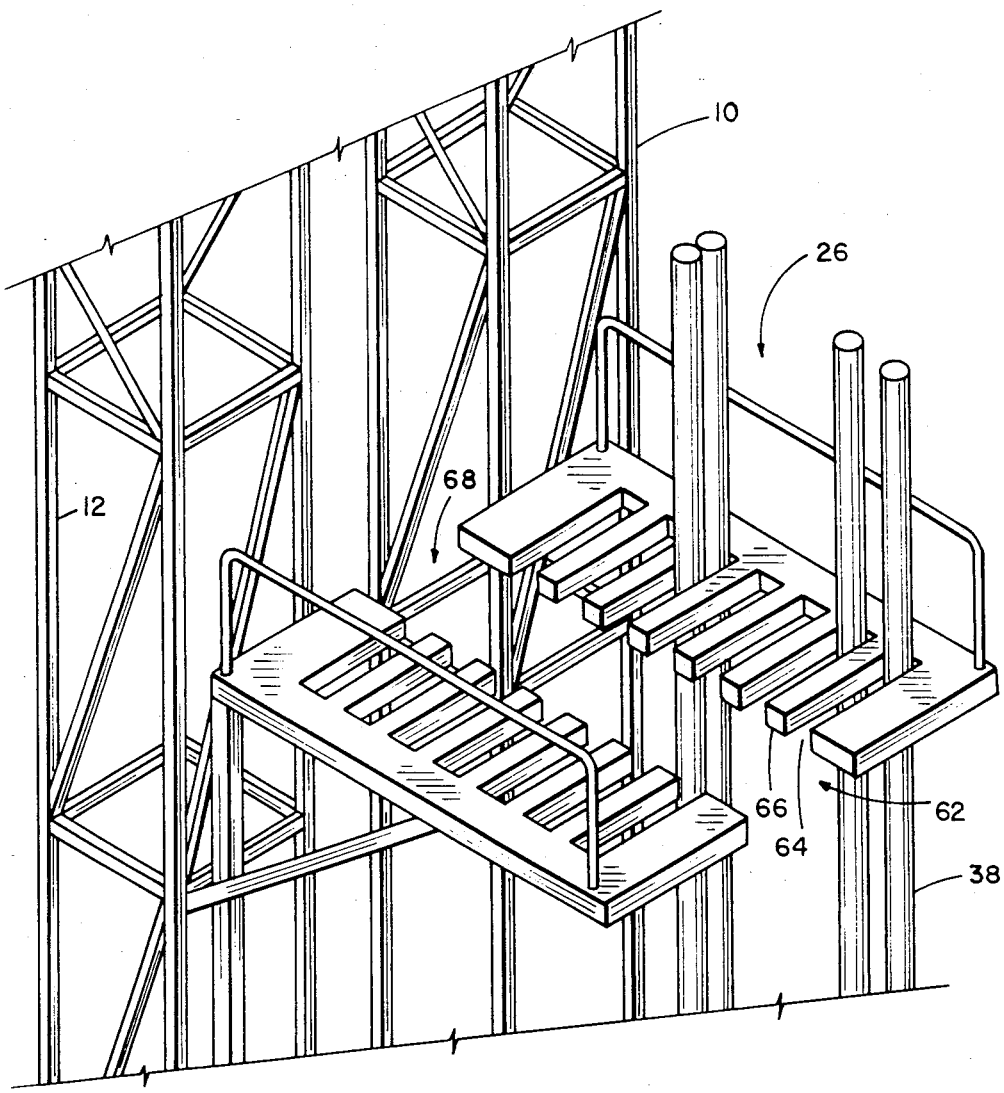
FIG. 4 is a perspective view of the racking board of my invention.

As shown in FIG. 4 racking board has an outside opening 62 to facilitate placing of the pipe 38 into the slots 64 between fingers 66 of the racking board 26. There is also an opening 68 between racking board 26 and the interior of the derrick. Crane 40 can be used to lift pipe through opening 62 to store pipe 38 within the racking board as shown in FIG. 4. When needed pipe 38 can be moved by traveling block 24 to the interior of the derrick within working space 16.

It is thus seen that with my design I rack the stored pipe 180° from the V-door and completely outside the derrick frame or legs. This results in that there is no limitation on the amount of drill pipe or other type pipe that can be racked or stored in racking board 26. It is further quite clear that the pipe stored in racking board 26 does not restrict in any way the entry of pipe through the V-door 54. Further, my stored pipe 38 does not interfere with or reduce the working space 16.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A drilling rig for drilling a hole in the earth which comprise:

a mast having a center which defines the location at which the hole will be drilled and having a first, a second, a third and a fourth quadrant spaced radially about said center, with said second quadrant being spaced 90° degrees from said first quadrant and said fourth quadrant being 180° from said second quadrant, said mast having an interior working area:

a drawworks for said mast at one side of said center and in said first quadrant;

a V-door formed at the lower end of said mast and located in said second quadrant;

a racking means supported by said mast and is only in said fourth quadrant outside of the working area and outside said mast.

2. A drilling rig as defined in claim 1 including a crane supported at the top of said mast for lifting pipe from the ground into said racking means.

3. A drilling rig for drilling a hole in the earth which comprises:

a drilling mast having a first leg and a second leg parallel to said first leg and spaced therefrom forming a work space therebetween, each leg being of uniform cross sectional size throughout its length, there being a first, second, third and fourth quadrant about said mast;

a drawworks supported at the lower end of said mast;

a crown block at the top end of said mast and supporting a traveling block inside said work space by a live cable connected to said drawworks;

a V-door formed at the lower end of said mast in the second quadrant;

a racking board supported in said fourth quadrant and outside of said legs, said racking board including a plurality of parallel fingers forming pipe receiving slots therebetween, said racking board further having an outside opening therein on the outside side so that the pipemay enter through from the outside of said drilling mast.

4. A drilling rig as defined in claim 3 including a crane supported at the top of said mast for lifting pipe from the ground into said racking means through said outside opening.

5. A drilling rig as defined in claim 4 in which said racking board has an inside opening whereby stored pipe may be moved by said traveling block through said inside opening to the work space.

* * * * *